US009851095B2

(12) United States Patent
Barrett et al.

(10) Patent No.: US 9,851,095 B2
(45) Date of Patent: Dec. 26, 2017

(54) CANDLES AND CANDLE HOLDER

(76) Inventors: Michael Barrett, Clifden (IE); Michael Murphy, Cahir (IE)

( * ) Notice: Subject to any disclaimer, the term of this patent is extended or adjusted under 35 U.S.C. 154(b) by 1525 days.

(21) Appl. No.: 12/734,075

(22) PCT Filed: Oct. 9, 2008

(86) PCT No.: PCT/EP2008/063538

§ 371 (c)(1),
(2), (4) Date: Jun. 25, 2010

(87) PCT Pub. No.: WO2009/047293

PCT Pub. Date: Apr. 16, 2009

(65) Prior Publication Data

US 2010/0291500 A1 Nov. 18, 2010

(30) Foreign Application Priority Data

Oct. 10, 2007 (GB) ..... 0719750.2

(51) Int. Cl.
*F23D 3/16* (2006.01)
*F21V 35/00* (2006.01)
(Continued)

(52) U.S. Cl.
CPC ..... *F21V 35/00* (2013.01); *A47G 33/00* (2013.01); *F21S 13/12* (2013.01); *F23D 3/16* (2013.01)

(58) Field of Classification Search
CPC ..... F21V 35/00
(Continued)

(56) References Cited

U.S. PATENT DOCUMENTS 401,592 A 4/1889 Roelofs
422,989 A * 3/1890 Jensen ..... F21V 35/00 431/297
(Continued)

FOREIGN PATENT DOCUMENTS

CA 2361199 A1 5/2002
DE 7410283 4/1974
(Continued)

OTHER PUBLICATIONS

International Preliminary Report on Patentability and Written Opinion, Apr. 13, 2010, 7 pages.
(Continued)

*Primary Examiner* — Avinash Savani
*Assistant Examiner* — Aaron Heyamoto
(74) *Attorney, Agent, or Firm* — Drinker Biddle & Reath LLP

(57) ABSTRACT

A candle holder comprising a body having a mouth, a base and sides that connect the mouth to the base is provided. The mouth comprises an opening arranged to receive a candle and at least a portion of the sides taper inwardly from the mouth towards the base. The inward most point of the tapered portion of the sides defines an aperture having a size which is less than that of the widest part of the candle. Also provided are a candle and a candle stand having a catching device for use with the candle holder. In use, wax and waste material from the candle pass through the aperture of the candle holder into the catching device. Thus, the candle holder can be reused repeatedly without the need for cleaning or replacement of the candle holder.

8 Claims, 9 Drawing Sheets

(51) Int. Cl.
*A47G 33/00* (2006.01)
*F21S 13/12* (2006.01)

(58) Field of Classification Search
USPC ..... 431/292, 288, 289, 295
See application file for complete search history.

(56) References Cited

U.S. PATENT DOCUMENTS

| | | | | |
|---|---|---|---|---|
| 679,984 | A | 8/1901 | O'Reilly | |
| 1,636,994 | A * | 7/1927 | Greenan | 431/253 |
| 1,704,729 | A | 3/1929 | Deckert | |
| 1,926,362 | A | 9/1933 | Berger | |
| 2,025,096 | A | 12/1935 | Deckert | |
| 2,057,943 | A | 10/1936 | Friedrichs | |
| 2,315,803 | A * | 4/1943 | Lipari | 431/291 |
| 2,530,288 | A | 11/1950 | Ciano | |
| 3,330,132 | A | 7/1967 | Dick et al. | |
| 3,453,686 | A | 7/1969 | Bjorck | |
| 4,158,912 | A | 6/1979 | Erdmann | |
| 4,894,008 | A | 1/1990 | Lee | |
| 5,178,451 | A | 1/1993 | Henry | |
| 5,292,245 | A | 3/1994 | Spoonhour | |
| D442,300 | S | 5/2001 | Poppick et al. | |
| 6,695,611 | B2 * | 2/2004 | Lee | 431/293 |
| 6,709,266 | B2 * | 3/2004 | Jensen | F21V 35/00 30/453 |
| D496,473 | S | 9/2004 | D'Onofrio | |
| 2001/0005573 | A1 * | 6/2001 | Furner et al. | 431/292 |
| 2002/0080604 | A1 | 6/2002 | Niermann | |
| 2003/0103346 | A1 * | 6/2003 | Joyner | F21V 37/00 362/209 |
| 2004/0031722 | A1 * | 2/2004 | Reed | B42D 15/045 206/575 |
| 2005/0095545 | A1 | 5/2005 | Tischendorf | |

FOREIGN PATENT DOCUMENTS

| | | | | |
|---|---|---|---|---|
| DE | 2628768 | A | | 12/1977 |
| DE | 28 09 916 | | | 9/1979 |
| DE | 2809916 | | | 9/1979 |
| DE | 20219965 | U | | 2/2003 |
| DE | 202 19 965 | | | 4/2003 |
| DE | 20219965 | U | * | 4/2003 |
| DE | 20219965 | U | | 4/2003 |
| DE | 20319435 | U1 | | 3/2004 |
| DE | 202006015961 | U | | 3/2007 |
| EM | RCD000474267-0003 | | | 3/2006 |
| EM | RCD000809660-0001 | | | 10/2007 |
| FR | 1 579 688 | | | 8/1969 |
| FR | 2733821 | A1 | | 11/1996 |
| FR | 2891892 | | | 4/2007 |
| GB | 10207 | | | 0/1911 |
| GB | 24603 | | * | 0/1910 |
| GB | 28634 | | | 0/1905 |
| GB | 753059 | A | | 7/1956 |
| GB | 2037895 | A | | 7/1980 |
| GB | 2045028 | A | | 10/1980 |
| GB | 2418981 | | | 12/2006 |
| IE | 21142 | | | 12/1956 |
| SE | 520737 | C2 | | 11/2003 |
| WO | WO 01/65173 | | * | 9/2001 |
| WO | WO 03/070865 | | | 8/2003 |

OTHER PUBLICATIONS 000018197-0001, Aug. 2003, Office of Harmonization in the International Market—RCD Online—Community Designs, 2 pages.
000025093-0001, Sep. 2003, Office of Harmonization in the International Market—RCD Online—Community Designs , 2 pages.
000025093-0002, Sep. 2003, Office of Harmonization in the International Market—RCD Online—Community Designs , 2 pages.
000078829-0001, Jan. 2004, Office of Harmonization in the International Market—RCD Online—Community Designs , 2 pages.
000256383-0001, Feb. 2005, Office of Harmonization in the International Market—RCD Online—Community Designs , 2 pages.
000361605-0001, Aug. 2005, Office of Harmonization in the International Market—RCD Online—Community Designs , 2 pages.
000382536-0001, Sep. 2005, Office of Harmonization in the International Market—RCD Online—Community Designs , 2 pages.
000404322-0002, Nov. 2005, Office of Harmonization in the International Market—RCD Online—Community Designs , 2 pages.
000474267-0001, Mar. 2006, Office of Harmonization in the International Market—RCD Online—Community Designs , 2 pages.
000474267-0003, Mar. 2006, Office of Harmonization in the International Market—RCD Online—Community Designs, 2 pages.
000474267-0007, Mar. 2006, Office of Harmonization in the International Market—RCD Online—Community Designs , 2 pages.
000602313-0003, Nov. 2006, Office of Harmonization in the International Market—RCD Online—Community Designs , 2 pages.
000602313-0005, Nov. 2006, Office of Harmonization in the International Market—RCD Online—Community Designs , 2 pages.
000651633-0005, Feb. 2007, Office of Harmonization in the International Market—RCD Online—Community Designs , 2 pages.
000651633-0006, Feb. 2007, Office of Harmonization in the International Market—RCD Online—Community Designs , 2 pages.
000694005-0001, Jun. 2007, Office of Harmonization in the International Market—RCD Online—Community Designs , 2 pages.
000694013-0002, May 2007, Office of Harmonization in the International Market—RCD Online—Community Designs , 2 pages.
000694021-0001, May 2007, Office of Harmonization in the International Market—RCD Online—Community Designs , 2 pages.
Search Report, GB0719750.2, 2 pages, Feb. 8, 2008.
Search Report, PCT/EP2008/063538, 6 pages, Jan. 26, 2009.
Written Opinion of International Searching Authority, PCT Application PCT/EP2008/063538, 6 pages, Jan. 26, 2009.
EP Examination Report, Communication Pursuant to Article 94(3), dated Oct. 10, 2014, 6 pgs.
EPO Communication Pursuant to Rule 114(2), dated Mar. 3, 2015, 5 pgs.
Second European Examination Report, Feb. 26, 2014 for Application No. 08805181.8, 14 pages.
Communication Pursuant to Rule 114(2) EPC, European Patent Office Jul. 17, 2014.
Notice of opposition to EP 2210038, dated Aug. 2, 2016, pp. 7.
Notice of opposition to EP 2210038, dated Aug. 10, 2016, 20 pages.

* cited by examiner

CANDLES AND CANDLE HOLDER

FIELD OF INVENTION

The present invention relates to candle holders, candles and candle stands.

BACKGROUND TO THE INVENTION

Candles are commonly used, for example in churches and other religious buildings, houses, restaurants, hotels, bars, other catering establishments and health spas. Generally the candles are placed in candle holders before and during use wherein the candle holder holds the candle before the candle is lit and whilst the candle is burning. After the candle has finished burning, residual wax and other waste material such as the candle wick often remain in, or adhered to, the candle holder. Generally this material must be removed before a new candle can be inserted in the candle holder. In some cases, the candle further comprises a metal base, which must also be removed before being replaced with a new candle. Alternatively the candle holder must be disposed of and a new candle holder provided.

Many churches, or other such religious buildings, have candle stands that hold a number of candles, for example, votive candles, which are small candles that are typically white or beeswax yellow. In some cases, the candle stand includes integrally formed candle holders in which the candles are directly placed without the use of separate individual candle holders. During use, wax from the candles may adhere to these integrally formed candle holders. Typically, after the candle has burnt out, these candle holders must be cleaned to remove adhered wax and other residual material before new candles can be placed in the candle holders. Cleaning of these integrally formed candle holders is usually carried out by scraping the residual wax and other material from the candle holder. This can be a difficult task, as well as time consuming and labour intensive. Furthermore, manual cleaning can sometimes result in damage to the candle holders of the candle stand, for example by splitting the candle holders.

In some cases, each candle is provided with an individual discrete candle holder, for example a metallic or plastic cup-shaped holder in which the candle sits. In such cases, the candle holder is placed on the candle stand with the candle contained therein. Once the candle has burnt out, the candle holder is disposed of, together with any residual wax or other material, such as the candle wick or the metal base. The use of a separate candle holder obviates the requirement for manual cleaning of the candle stand after each use. However, the use of a separate candle holder results in a large amount of waste as the candle holder is disposed of each time a candle is being replaced.

In catering establishments, such as hotels, restaurants and bars, candle holders may be provided, for example, in the form of empty bottles, such as wine bottles, or vases. During use, molten wax may drip from the candle onto a table or other surface on which the candle is placed. This wax can be a safety hazard whilst hot and can be difficult to remove when cooled. Furthermore, repeated burning of candles leads to the build-up of wax on the surface of the candle holder, for example on the outer surface of the neck of the bottle being used as a candle holder. This can be unsightly and the build-up of wax on the portion of the candle holder in which the candle is placed during use, for example in the neck of the bottle, can hinder the repeated use of the candle holder. The candle holder must in that case either be cleaned to remove the wax or replaced. Cleaning the candle holder can be difficult as hardened wax adheres to the candle holder. Replacing the candle holder after each use is expensive and wasteful.

Following extensive research, the inventors have identified a candle holder which can be used repeatedly for the burning of candles, but obviates the requirement for cleaning and removing residual wax between uses.

SUMMARY OF THE INVENTION

According to a first aspect of the invention there is provided a candle holder comprising a body having a mouth, a base and sides that connect the mouth to the base, the mouth comprising an opening arranged to receive a candle and at least a portion of the sides tapering inwardly from the mouth towards the base, characterised in that an inward most point of the tapered portion of the sides defines an aperture having a size which is less than that of the widest part of the candle.

The candle is initially held within the candle holder as the widest part of the candle is greater than the size of the aperture in the candle holder. During burning of the candle, the size of the candle decreases such that the candle falls through the aperture. The candle holder of the present invention thus reduces build-up of wax and other residues within the candle holder as this material exits through the aperture of the candle holder. Accordingly, repeated manual cleaning of the candle holder each time a candle is burnt and replaced is not required. Furthermore, as the candle holder is reusable, there is no need to dispose of the candle holder each time a candle provided within the candle holder is burnt. Thus, the overall amount of waste is dramatically reduced as the candle holder does not need to be disposed of each time a candle is burnt.

The tapered portion of the sides assists both in retaining the candle within the candle holder prior to burning the candle and in funneling the liquefied wax and other waste material through the aperture. The tapered portion may be in the form of a straight or curved tapering of at least a portion of the sides of the candle.

The aperture is provided at the point at which the sides of the candle holder are most proximal to each other. Defining the aperture by the inward most point of the tapered portion of the sides reduces the risk of the aperture becoming clogged with wax and/or other residual material. For example, if the aperture is defined by or surrounded by an inwardly projecting rim or lip rather than by the lower or inward most point of the tapered portion of the sides, wax may build up on the inwardly projecting rim or lip, thus increasing the risk of the aperture becoming clogged. If clogging occurs, it will be necessary to clean the candle holder or to replace the candle holder.

Typically, the aperture is entirely defined by the inward most point of the tapered portion of the sides.

In certain embodiments, the inward most point of the tapered portion of the sides is provided at the base of the candle holder.

This is advantageous as the candle is positioned in the lowest portion of the candle holder. Thus, residual wax is only required to pass through the aperture to exit the candle holder and the risk of the residual wax becoming adhered to the candle holder is reduced.

In certain embodiments, the inward most point of the tapered portion of the sides defines a single aperture.

If more than one aperture is present, the presence of connecting portions of the candle holder between the apertures increases the risk of the apertures becoming clogged with residual wax and/or other waste materials as the residual wax may adhere to these connecting portions in use. A single aperture ensures that no connecting portions are necessary such that the risk of clogging is reduced.

In certain embodiments, the candle is retained within the candle holder by the tapered portion of the sides of the candle holder. Typically, the candle is retained within the candle holder by the inward most point of the tapered portion of the sides.

As the candle is retained within the candle holder by the inwardly tapered arrangement of the sides of the candle holder, there is no requirement for the base of the candle holder to be supplied with a support, such as a lip or a rim, to support and retain the candle within the candle holder. Residual wax and/or other waste materials may adhere to the support in use. Accordingly, the absence of a support reduces the risk of the aperture becoming clogged.

Typically, the aperture is free from obstructions. Obstructions may be in the form of a wire mesh, inwardly extending lip or other support structure. The absence of these features prevents wax from adhering to these features during use, in which case the aperture may become clogged with wax and other residual materials.

In certain embodiments, the sides of the candle holder extend upwardly beyond the top of the candle when the candle is positioned in the candle holder.

This ensures that a flame of the candle is enclosed by the sides of the candle holder in use. This improves safety as the flame does not extend externally of the candle holder.

In certain embodiments, the sides of the candle holder comprise walls.

In certain embodiments, the sides of the candle holder comprise two or more tines. Typically, at least a portion of the tines tapers inwardly in the direction of the mouth of the candle holder to the base.

The use of the tines in place or in addition to the walls of the candle holder substantially reduces the surface area of contact between the candle holder and the candle. This, in turn, reduces the risk of wax adhering to the candle holder and remaining in the candle holder after a candle has been burnt.

In certain embodiments, the sides of the candle holder consist of two or more tines. In alternative embodiments, the sides of the candle holder comprise two or more tines in addition to walls. When used in addition to walls of the candle holder, the tines are positioned between the candle and the walls of the candle holder to reduce contact there between. This reduces the amount of wax which adheres to the walls of the candle holder in use.

The candle holder may comprise a lip extending transversely away from the candle holder. Typically, the lip is provided at the mouth of the candle holder located at the upper part of the candle holder body. The lip may extend partially or completely around the outer periphery of the candle holder. In certain embodiments, a plurality of discrete lips or outwardly extending protrusions may be provided.

The lip or plurality of protrusions allows the candle holder to be retained within a further candle holder or candle stand, wherein the outwardly extending lip or protrusions rest on the further candle holder or candle stand. For example, the candle holder may be placed in a bottle such that the lip sits on the mouth of the bottle to hold the candle holder in place. Alternatively, the candle holder may be placed in a candle stand of the type often used in a church such that the lip sits on the periphery of an opening for the candle holder in the candle stand.

In certain embodiments, the candle holder is provided in an outer cylinder, the outer cylinder comprising a cylindrical body having a mouth and a base, the mouth comprising a first opening and the base comprising a second opening.

The candle holder, and in particular the outer facing surface of the sides of the candle holder, may become hot during use. By placing the candle holder in the outer sheath, the candle holder may be handled without risk of burning. In use, the lip or protrusions of the candle holder may rest on the mouth of the outer cylinder to position the candle holder within the outer cylinder.

In certain embodiments, the outer cylinder comprises a ledge extending transversely away from the outer cylinder. The ledge may extend partially or completely around the outer periphery of the outer cylinder. In certain embodiments, a plurality of discrete ledges may be provided.

This ledge allows the outer cylinder to engage a further candle holder or candle stand in use. For example, the outer cylinder may be placed in a candle stand such that the ledge rest on the periphery of an opening in the candle stand.

In certain embodiments, the candle holder comprises a plurality of openings, each opening being arranged to receive a candle, and a plurality of apertures, each aperture being defined by a portion of the sides of the candle holder tapering inwardly from the mouth of the candle holder towards the base and each aperture having a size which is less than that of the widest part of the candle to be received therein.

The present invention further provides a candle suitable for use with the candle holder of the present invention.

Accordingly, a second aspect of the invention provides a candle having a top, a base and sides connecting the top to the base, characterised in that at least a portion of the sides of the candle taper inwardly from the top to the base.

The tapering of the sides of the candle results in improved burning of the candle. The degree of tapering of the sides may be varied depending upon the length of the desired burning time of the candle.

In certain embodiments, the candle is of a size and shape suitable for use with the candle holder of the first aspect of the invention. Typically, the candle is sized and shaped such that the candle may be received through the opening in the mouth of the candle holder, but does not fit through the aperture of the candle holder. Typically, the tapered portion of the sides of the candle corresponds to the tapered portion of the sides of the candle holder. Typically, burning of the candle results in a reduction of the outer dimensions or circumference of the candle such that the candle falls through the aperture of the candle holder.

In certain embodiments, the sides of the candle taper inwardly from the top of the candle to the base.

Typically, the candle has a frustoconical shape.

In certain embodiments, the dimensions of the base of the candle are less than the dimensions of the aperture of the candle holder.

This assists in allowing the candle to fall through the aperture in the candle holder once the candle has been burnt or partially burnt.

In certain embodiments, the candle has an inverted cone shape, such that the base of the candle forms a point.

This candle is particularly advantageous for use with the candle holder of the first aspect of the invention as the shape of the base of the candle reduces the risk of an unburnt portion of the candle remaining in the candle holder after use. Specifically, the downwardly facing point at the base of the candle assists in pulling the remains of the candle through the aperture.

According to a further aspect of the present invention, there is provided a kit of parts comprising the candle holder of the first aspect of the present invention and at least one candle of the second aspect of the present invention.

The present invention further extends to a candle stand suitable for use with the candle holder of the first aspect of the present invention.

According to a further aspect of the present invention, there is provided a candle stand comprising a plurality of openings for receipt of candle holders according to a first aspect of the present invention and catching means positioned beneath the openings for catching waste material produced by burning a candle.

In certain embodiments, the candle holders and the candle stand are integrally formed.

In certain embodiments, the candle holder is placed in one of the openings of the candle stand such that the lip of the candle holder abuts an edge of the opening.

In alternative embodiments, the outer cylinder is placed in one of the openings of the candle stand such that the ledge of the outer cylinder abuts an edge of the opening.

In certain embodiments, the candle stand and the outer cylinder may be integrally formed.

In certain embodiments, the catching means is filled with a non-flammable liquid in use. Typically, the non-flammable liquid is water, but any non-flammable liquid which is suitable to extinguish the flame of a burning candle may be used.

Residual wax passing through the aperture of the candle holder of the present invention may in some cases still be alight when it falls into the catching means of the candle stand. This represents a safety hazard. The provision of a catching means filled with a non-flammable liquid such as water ensures that any wax still burning is quenched immediately upon receipt by the catching means. This is further advantageous as the requirement for the use of other fire retardant materials such as tin foil is obviated. When tin foil is used, the wax may become adhered to the tin foil. It is then difficult to separate the wax from the tin foil, in which case the wax cannot be recycled and the tin foil cannot be re-used. The use of a non-flammable liquid is further advantageous as it causes the wax to solidify upon receipt in the catching means such that the wax can easily be recycled and there is no requirement to first of all separate the wax from tin foil or other material.

In certain embodiments, the catching means is removable. This enables easy access to the catching means for cleaning.

In certain embodiments, the catching means is a tray, typically a metal tray. The tray catches waste material which is released through the aperture of the candle holder when a candle is burnt.

In certain embodiments, the catching means comprises at least one netted tray. Typically the netted tray comprises a handle. In certain embodiments, the catching means comprises at least one netted tray positioned within a second tray.

In use, the netted tray is positioned beneath the apertures of the candle holders. Residual wax falling through the apertures of the candle holders of the present invention is caught by the netted tray. At regular intervals, the netted tray is removed and emptied of solidified residual wax. The residual wax from the netted tray can be recycled. The netted tray enables the wax to be easily separated from the non-flammable liquid in the catching means. Furthermore, the wax can be removed without having to also remove the non-flammable liquid.

BRIEF DESCRIPTION OF THE DRAWINGS

The present invention will now be described with reference to the following figures as described briefly below, which are provided for the purpose of illustration and are not intended to be construed as being limiting on the present invention.

DETAILED DESCRIPTION

Figure 1:
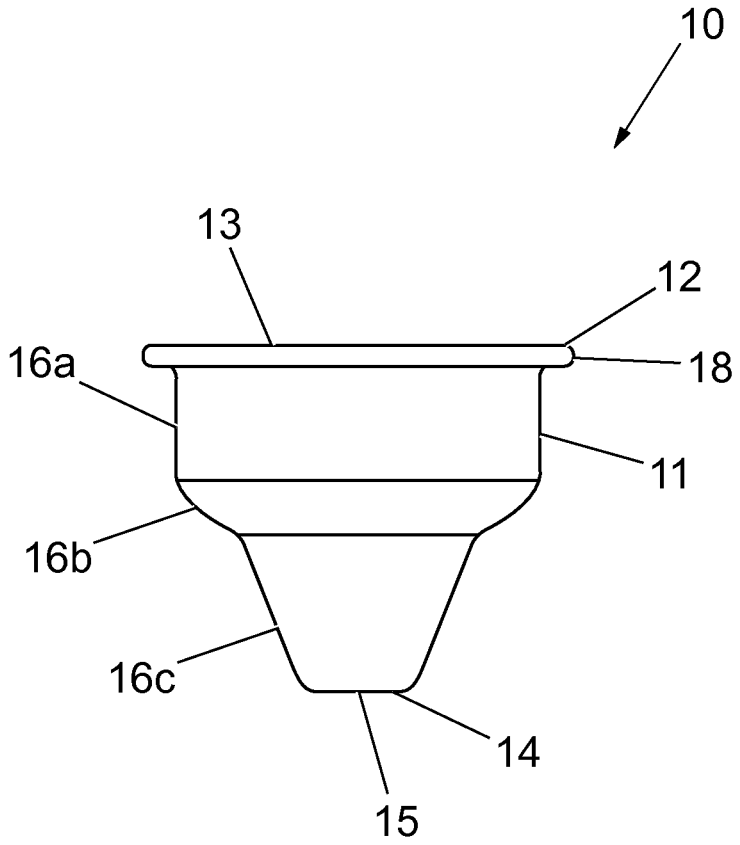
FIG. 1 is a side elevation of a candle holder according to the present invention.
Figure 2:
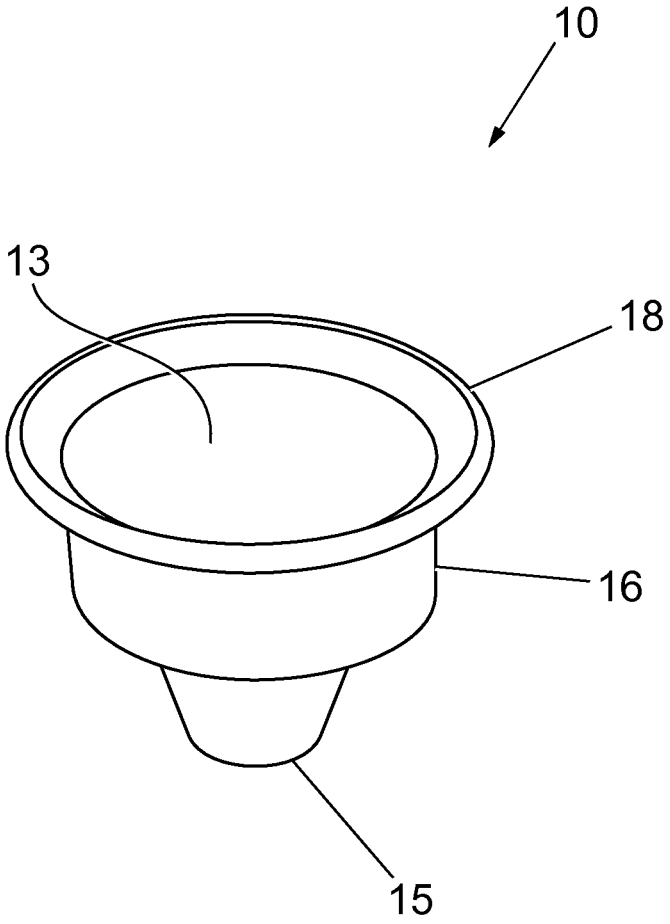
FIG. 2 is a side perspective view of the candle holder of FIG. 1.

As shown in FIGS. 1 and 2, a candle holder 10 comprises a body 11 having a mouth 12 and a base 14. The mouth 12 comprises an opening 13. The base 14 comprises an aperture 15. Both the opening 13 and the aperture 15 as shown in FIGS. 1 and 2 are circular in shape. The diameter of the aperture 15 is less than that of the opening 13.

Although the opening 13 shown in FIGS. 1 and 2 is circular in shape, any shape suitable for receipt of a candle may be used, for example, triangular, square, rectangular, oval, octagonal or pentagonal. The aperture may be any shape which retains the unburnt candle in the candle holder but allows material from the burnt candle to pass through the aperture. Typically, the aperture is the same shape as the opening, but this is not essential. For example, the opening may be square for receipt of a square candle and the aperture may be circular.

As shown in FIG. 1, the mouth 12 and the base 14 are connected by walls 16 comprising three portions 16*a*, 16*b*, 16*c*. In the first upper portion 16*a*, which is positioned adjacent to the mouth 12, the walls 16 are substantially vertical, as shown in FIG. 1. In the second mid portion 16*b*, which is positioned directly beneath the first portion 16*a*, the walls 16 taper inwardly sharply. In the third lower portion 16*c*, which is adjacent the base 14, the walls 16 are tapered gradually inwardly. The aperture 15 is defined by the inward most point of the tapered portion of the walls 16*c* at the base 14.

In the candle holder 10 shown in FIGS. 1 and 2, only a portion of the walls 16 are tapered. However, the entire walls may also be tapered such that the tapered portion of the walls extends from the mouth of the candle holder to the base.

An outwardly extending lip 18 is provided at the mouth 12 of the candle holder 10. The lip 18 may be sized such that, in use, it abuts an edge of an opening in a candle stand. Alternatively, the lip 18 may be sized to abut a mouth of an outer cylinder in which the candle holder 10 is placed.

The candle holder 10 has a typical top diameter of 6 cm and a typical base diameter of 1.5 cm. Typically, the height of the candle holder 10 is 5.5 cm. However, the size of the candle holder 10 and the degree of tapering of the walls 16 may vary depending upon the size of the candle being used.

The candle holder 10 may be made from any suitable material, such as glass and/or metal. In particular, the use of brass allows efficient transfer of heat throughout the candle holder 10. This results in improved liquefying of candle wax and reduces adherence of candle wax to the candle holder 10. This improves flow of the wax and any other residual material through the aperture 15 of the candle holder 10.

Figure 3:
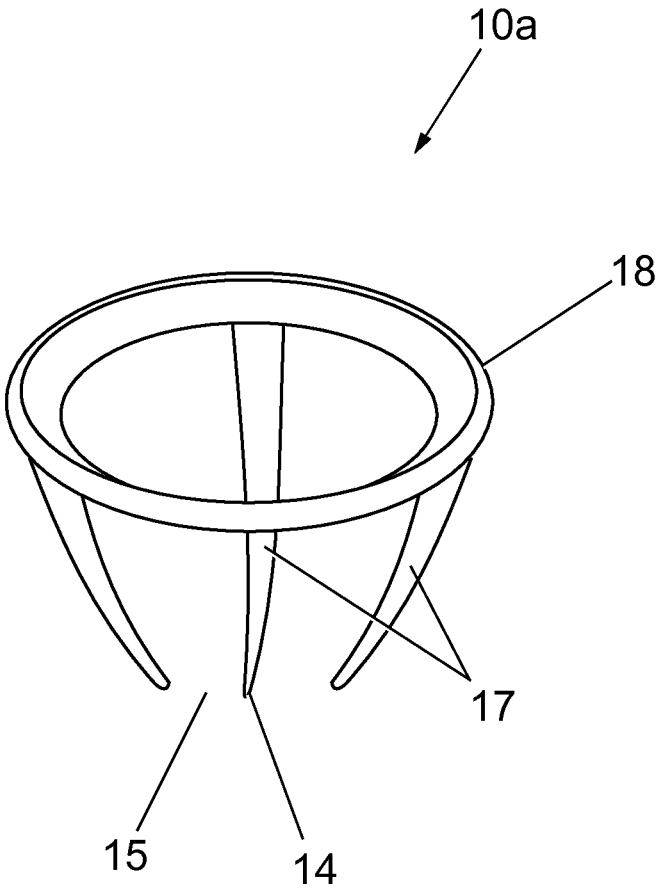
FIG. 3 is a side perspective view of an alternative embodiment of the candle holder of the present invention.

The candle holder 10 as shown in FIGS. 1 and 2 comprises a substantially inverted frustoconically shaped holder 10 wherein the mouth 12 is connected to the base 14 by the walls 16. In an alternative embodiment, the mouth 12 may be connected to the base 14 by spaced apart tapered tines 17, as shown in FIG. 3. The inward most point of the tapered tines 17 defines the aperture 15 at the base 14 of the candle holder 10*a*. The candle holder 10*a* shown in FIG. 3 comprises three tines 17 but any suitable number of tines may be used. The tines 17 may be made from any suitable material, including, but not limited to, a metal, such as brass.

In FIG. 3, the tines 17 are joined to the mouth 12 of the candle holder 10*a* but are not connected at the base 14. In alternative embodiments, the tines may be held together by any suitable additional or alternative means, such as a rim provided at the base 14 of the candle holder 10*a*.

The use of the tines 17 enhances drainage of the wax and other residual material from the candle holder 10*a* after use as the area of contact between the candle holder 10*a* and the candle is reduced. This, in turn, reduces the amount of wax adhering to the surface of the candle holder 10*a* and, thus, remaining in the candle holder 10*a* after a candle has been burnt.

As shown in FIG. 3, the tines 17 may be provided in place of the walls 16. In an alternative embodiment (not shown), the tines 17 may be provided in addition to the walls 16. When used in addition to the walls 16, the tines 17 are positioned between the candle and the walls 16 such that contact there between is prevented. This prevents wax from adhering to the walls 16 of the candle holder 10 during use.

Figure 4:
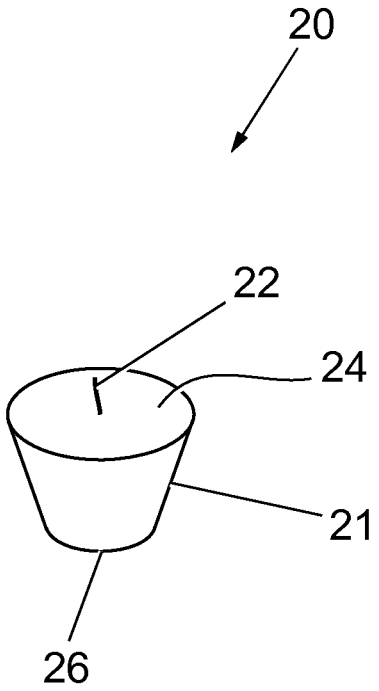
FIG. 4 is a side perspective view of a candle according to the present invention.

FIG. 4 shows a candle 20 having a frustoconical shape comprising a wick 22 provided at the top 24 thereof. The sides 21 of the candle 20 taper inwardly from the top 24 of the candle 20 towards the base 26 such that the diameter of the top 24 of the candle 20 is greater than that of the base 26 of the candle 20. In FIG. 3, both the top 24 and the base 26 are circular in shape but any suitable shape may be used. Although the candle 20 shown in FIG. 4 is frustoconical in shape, a candle having an inverted cone shape or other similar shape may also be used.

Typically, the candle 20 is made from a plant wax, such as soya wax. The use of soya wax reduces smoke from the candle 20 during burning. Thus, when used in a church, damage to the interior of the church by smoke is reduced.

The candle 20 has a typical top diameter of 3 cm and a typical base diameter of 1.5 cm. Typically, the height of the candle 20 is 2.5 cm. The degree of tapering of the walls 21 may vary depending upon the length of the desired burning time of the candle 20.

Figure 5:
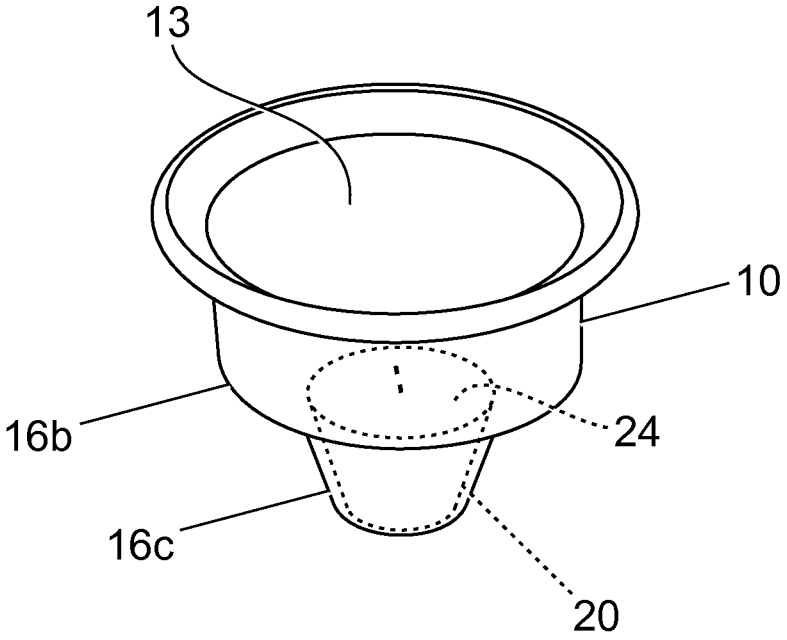
FIG. 5 is a side perspective sectional view of the candle of FIG. 4 when positioned in the candle holder of FIG. 1.

In use, the candle 20 is placed in the candle holder 10 as shown in FIG. 5. The candle 20 is inserted through the opening 13 of the candle holder 10 and positioned adjacent the third portion 16*c*. The diameter of the base 26 of the candle 20 is approximately equal to the diameter of the aperture 15 of the candle holder 10. The tapered walls 16*c* of the candle holder 10 retain the candle 20 within the candle holder 10. When the candle 20 is lit, the wax is liquefied. The shape and material of the candle holder 10 are designed to improve liquefaction of the wax. This enhances flow of the wax and any other residual material through the aperture 15 of the candle holder 10.

As shown in FIG. 5, the walls 16 of the candle holder 10 extend upwardly beyond the top 24 of the candle 20. The top 24 of the candle 20 is positioned adjacent the junction between the first portion 16*b* and the second portion 16*c* of the candle holder 10. Accordingly, a flame of the candle 20 will be at all times enclosed by the walls 16 of the candle holder 10. This improves safety as an exposed flame may be dangerous, particularly in the case of a church where the building is accessible to the public. This will reduce the high insurance premiums payable by churches and other such buildings where candles are regularly used.

In use, the candle holder 10 may optionally be positioned in a further candle holder, for example, an empty bottle such as an empty wine bottle or a vase, such that wax and other residual material exiting through the aperture 15 is caught by the further candle holder. The use of the candle holder 10 ensures that wax is funneled into the further candle holder, for example, the empty wine bottle. Furthermore, there is no requirement to clean or replace the candle holder 10 between uses as the wax and other residual waste material does not remain in the candle holder 10.

Figure 6:
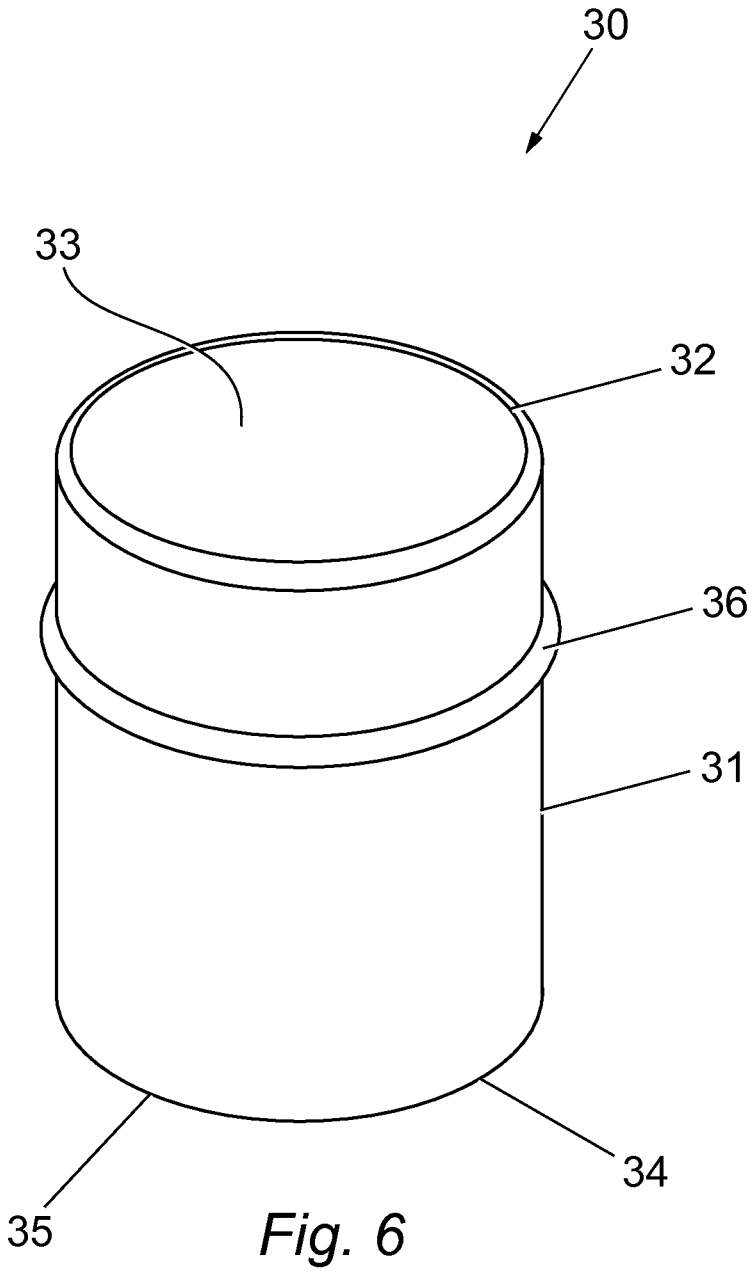
FIG. 6 is a side perspective view of an outer cylinder.

In use, the candle holder 10 may optionally be placed in an outer cylinder 30. As shown in FIG. 6, the outer cylinder 30 comprises a cylindrical body 31 having a mouth 32 and a base 34. The mouth 32 comprises a first opening 33 and the base 34 comprises a second opening 35. In use, the candle holder 10 is placed in the outer cylinder 30 such that the outwardly extending lip 18 of the candle holder 10 abuts the mouth 32 of the outer cylinder 30, as shown in FIG. 7.

Figure 7:
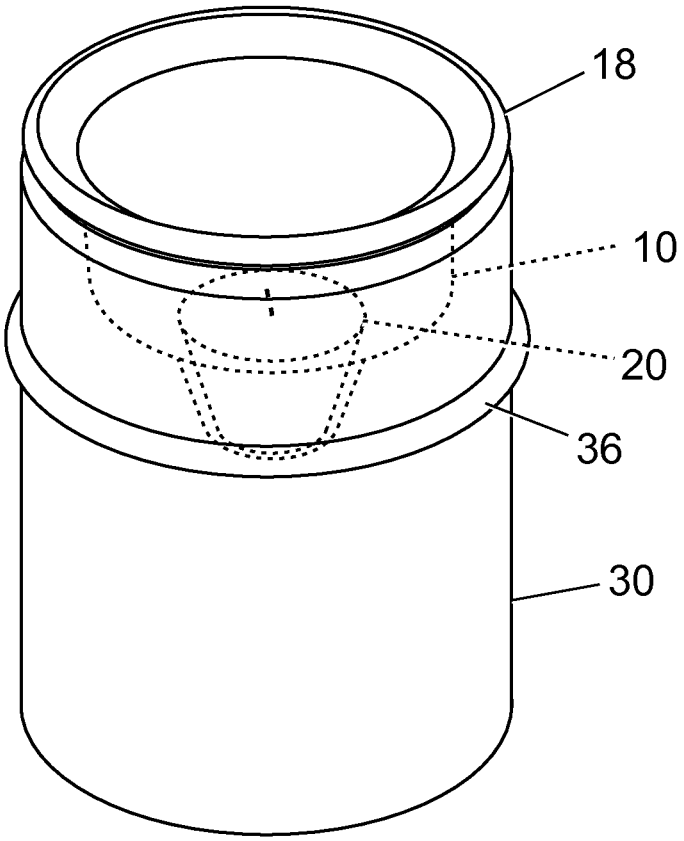
FIG. 7 is a side perspective sectional view of the candle holder and candle of FIG. 5 when positioned in the outer cylinder of FIG. 6.

The outer cylinder 30 is provided with an outwardly extending ledge 36 as shown in FIGS. 6 and 7. The ledge 36 extends outwardly from the cylindrical body 31. Typically, it is positioned approximately midway between the mouth 32 and the base 34. The ledge 36 is sized such that, in use, it abuts the edge of an opening of a candle stand to hold the outer cylinder 30 and candle holder 10 in position. As the walls 16, or tines 17, of the candle holder 10 may become hot during use, the outer cylinder 30 enables the candle holder 10 to be handled without risk of injury.

Furthermore, the outer cylinder 30 provides additional protection from the flame of the candle 20.

The outer cylinder 30 has a typical mouth and base diameter of 6 cm. Typically, the height of the outer cylinder 30 is 8 cm. However, the size of the outer cylinder 30 may vary depending upon the size of the candle holder 10.

Figure 8:
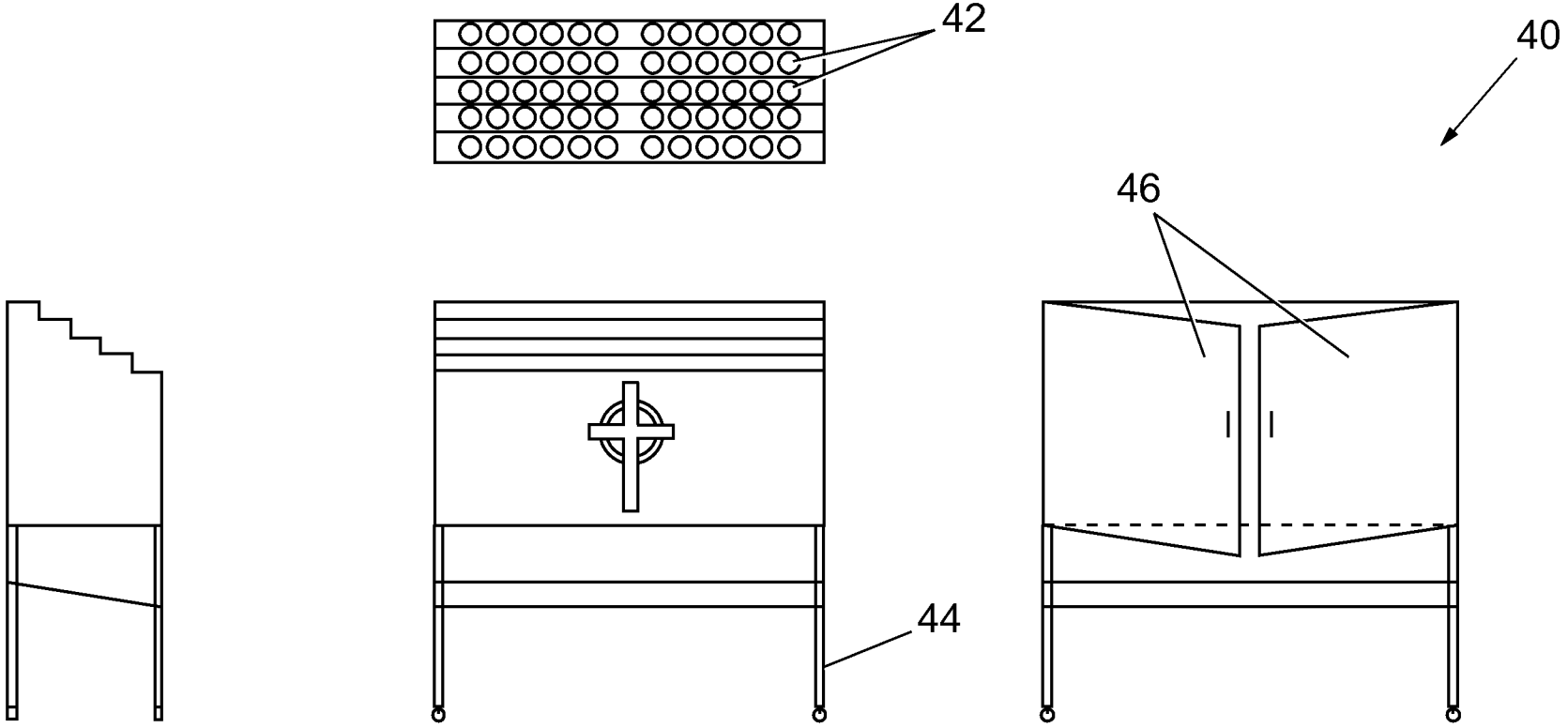
FIG. 8 shows top, side, front and back views of a candle stand according to the present invention.

FIG. 8 shows a candle stand 40 of the type generally found in churches. The candle stand 40 comprises a plurality of openings 42 for receipt of the candle holder 10 and/or outer cylinder 30 of the present invention and supporting means 44. The openings 42 are provided in rows wherein the rows are tiered such that the height of the rows increases from a front of the candle stand 40 to the back of the candle stand 40. Doors 46 are provided in the back of the candle stand 40 to allow access to a catching means 48 positioned beneath the openings 42. The catching means 48 serves to catch residual wax and other waste material produced when a candle is burnt. The catching means 48 shown in FIG. 9 comprises a water tray 50 and two netted trays 52. The netted trays 52 are provided with handles 54.

In use, the candle holder 10 may be placed directly in the opening 42 such that the lip 18 abuts an edge of the opening 42. Alternatively, the candle holders 10 may first of all be placed in the outer cylinder 30, such that the ledge 36 of each outer cylinder 30 abuts an edge of the opening 42. Candles

20 are placed in the candle holders 10. As the candle 20 burns, the wax of the candle 20 is heated and liquefies. The liquefied wax and other waster material, such as the wick, are drawn through the aperture 15 of the candle holder 10. This material falls into the catching means 48 comprising the netted trays 52 positioned within the water tray 50. The water tray 50 contains water. At regular intervals, the netted trays 52 are removed from the water tray 50 using the handles 54 and emptied before being replaced in the water tray 50. Several candles may be burnt before emptying of the netted trays 52 is necessary. Wax from the netted trays 52 may be recycled.

The candle stand 40 has a typical length of 1080 cm, a typical width of 400 cm and a typical height of 1187 cm at the back and 987 cm at the front.

Figure 9:
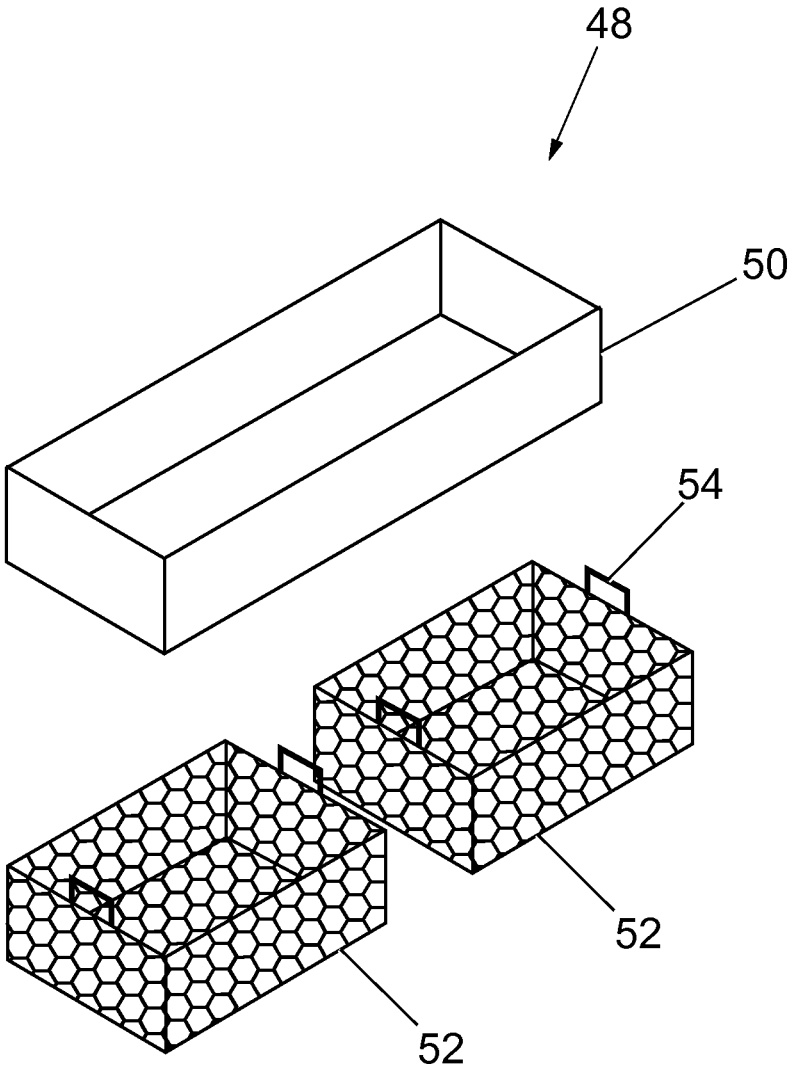
FIG. 9 shows a catching means comprising a water tray and a netted tray for use with the candle stand of FIG. 8.

In FIGS. 8 and 9, the catching means comprises a water tray 50 and two netted trays 52. However, any suitable non-flammable and preferably fire retardant liquid may be used in place of water. Further, any suitable number of netted trays 52 may be used.

The catching means may alternatively be provided in the form of a sand pit or otherwise, which is positioned beneath the openings 42 in the candle stand 40. The catching means may be removable for cleaning or may be replaced at regular intervals.

The candle holder and/or outer cylinder may be provided in a range of colours, and in particular in any colour commonly used in religions ceremonies. Suitable colours include red, blue, white and amber. Transparent candle holders and/or transparent other cylinders may also be used. Furthermore, the candle holder and/or outer cylinder may contain designs, drawings, names, etc, for example, the name of the hotel or establishment in which the candle holder or outer cylinder is being used. Typically, the candle holder may be sold in a package comprising four or more candles for use in the home and other environments. The candle holder may be sold, in particular, in retail markets such as shops, supermarkets, pound shops and any other type of retail trade.

Various modifications and variations to the described embodiments of the inventions will be apparent to those skilled in the art without departing from the scope of the invention.

The invention claimed is:

1. A combination of a candle, a candle holder and an outer cylinder, the candle holder comprising a body having a mouth, a base and sides that connect the mouth to the base, the mouth comprising an opening and at least a portion of the sides tapering inwardly from the mouth towards the base, wherein an inward most point of the tapered portion of the sides circumscribes an aperture, wherein the aperture is entirely defined by the inward most point of the tapered portion of the sides, and wherein the inward most point of the tapered portion of the sides is provided at the base of the candle holder;

the candle having a candle top, a candle base and candle sides connecting the candle top to the candle base, wherein at least a portion of the candle sides taper inwardly from the candle top to the candle base;

wherein the mouth opening of the candle holder body is arranged to receive the candle, the aperture of the candle holder body has a size which is less than that of the widest part of the candle, the candle base has a size which is less than that of the mouth of the candle holder body;

wherein the tapered portion of the candle sides corresponds to and abuts the tapered portion of the sides of the candle holder wherein the candle is retained within the candle holder solely by the abutting corresponding tapered portions of the sides of the candle and the candle holder;

wherein the candle holder comprises a lip extending transversely away from the candle holder;

wherein the candle holder is provided in the outer cylinder, the outer cylinder comprising a cylindrical body having a mouth and a base, the mouth comprising a first opening and the base comprising a second opening; and wherein the lip sits on the mouth of the outer cylinder to position the candle holder within the outer cylinder.

2. A combination of a candle, a candle holder, and an outer cylinder as claimed in claim 1 wherein the body of the outer cylinder comprises a ledge extending transversely away from the outer cylinder.

3. A combination of a candle, a candle holder, and an outer cylinder as claimed in claim 1 wherein burning of the candle results in a reduction of the outer dimensions of the candle.

4. A combination of a candle, a candle holder, and an outer cylinder as claimed in claim 1 wherein the candle has a shape of an inverted cone.

5. A combination of a candle stand, and at least one combination of a candle, a candle holder, and an outer cylinder as claimed in claim 1 wherein the candle stand comprises a plurality of openings for receipt of said at least one candle holder and a catching means positioned beneath the openings for catching waste material produced by burning said at least one candle.

6. A combination of a candle-stand and at least one combination of a candle, a candle holder, and an outer cylinder as claimed in claim 5 wherein the catching means is filled with a non-flammable liquid in use.

7. A combination of a candle stand and at least one combination of a candle, a candle holder, and an outer cylinder as claimed in claim 5 wherein the catching means comprises at least one netted tray.

8. A combination of a candle stand and at least one combination of a candle, a candle holder, and an outer cylinder as claimed in claim 5, wherein the at least one candle is in one of the candle holders wherein the tapered portion of the candle sides is retained within said one candle holder by the tapered portion of the sides of said one candle holder.

* * * * *